US005128663A

United States Patent [19]

Coulson

[11] Patent Number: 5,128,663

[45] Date of Patent: Jul. 7, 1992

[54] DISPLAY DEVICE INCORPORATING SEPARATELY OPERABLE PIXELS AND METHOD FOR OPERATING SAME

[75] Inventor: Ian Coulson, Maidenhead, England

[73] Assignee: Thorn Emi plc, London, England

[21] Appl. No.: 337,759

[22] Filed: Apr. 13, 1989

[30] Foreign Application Priority Data

Apr. 14, 1988 [GB] United Kingdom ..... 8808812

[51] Int. Cl.[5] ..... G09G 3/36

[52] U.S. Cl. ..... 340/784; 340/805; 340/793; 359/56

[58] Field of Search ..... 340/784, 802, 805, 807, 340/789, 811, 718, 719, 767, 793; 350/350 S, 332, 333

[56] References Cited

U.S. PATENT DOCUMENTS 4,800,382 1/1989 Okada et al. ..... 340/784

4,917,469 4/1990 Ross ..... 340/713

4,923,285 5/1990 Ogino et al. ..... 340/713

4,932,759 6/1990 Toyono et al. ..... 350/350 S

FOREIGN PATENT DOCUMENTS 2185614 7/1987 United Kingdom .

*Primary Examiner*—Jeffery A. Brier

*Assistant Examiner*—Chanh Nguyen

*Attorney, Agent, or Firm*—Fleit, Jacobson, Cohn, Price, Holman & Stern

[57] ABSTRACT

A method of addressing a display device comprising a matrix of separately operable pixels is provided. The method comprises the step of applying across a given pixel a voltage waveform comprising a latching pulse and an auxiliary pulse of amplitude smaller than the latching pulse. The amplitude of the auxiliary pulse is modulated to determine the latching effect of the latching pulse.

10 Claims, 20 Drawing Sheets

FIG. 5A
STROBE VOLTAGE AGAINST TIME
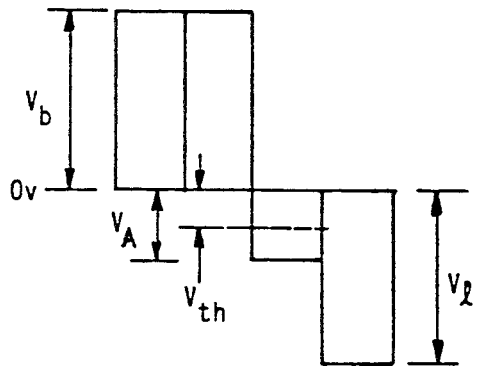
$V_A > V_{th}; V_{data} > V_A - V_{th}$
DATA VOLTAGES AGAINST TIME (SAME TIMESCALE) AND CORRESPONDING MODE
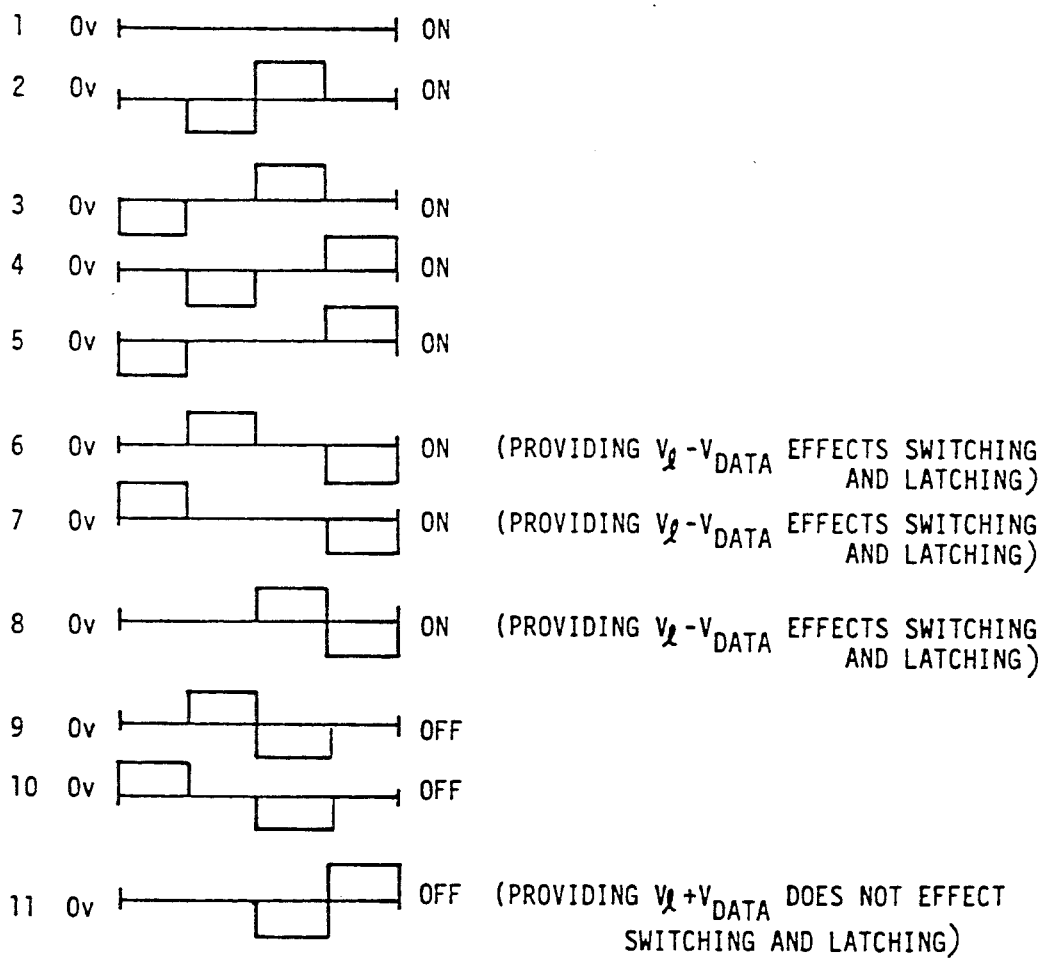
FIG. 5B

FIG. 6A

STROBE VOLTAGE AGAINST TIME

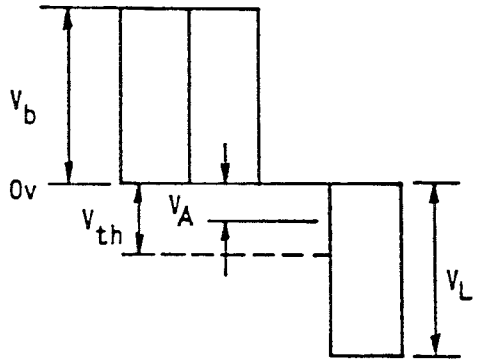

$V_A < V_{th}; V_{data} > V_{th} - V_A$ $V_A$ can be +ve or -ve

DATA VOLTAGES AGAINST TIME (SAME TIMESCALE) AND CORRESPONDING MODE

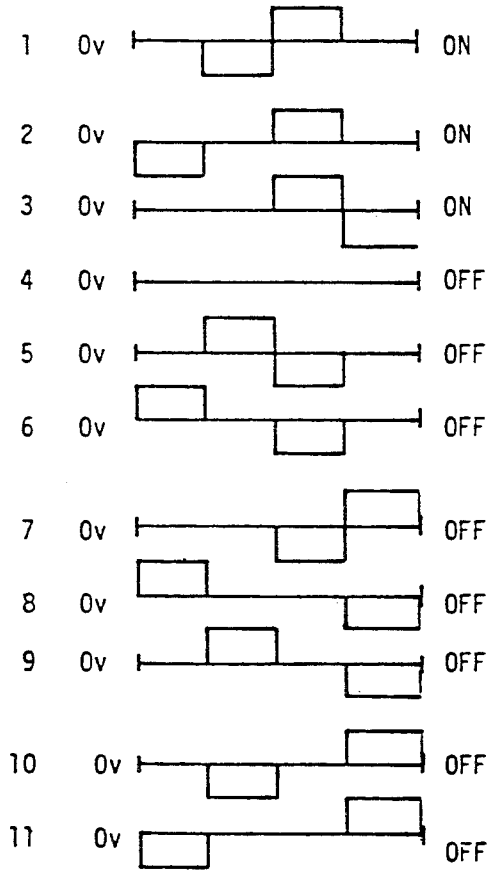

(PROVIDING $V_\ell - V_{DATA}$ EFFECTS SWITCHING AND LATCHING)

(PROVIDING $V_\ell - V_{DATA}$ DOES NOT EFFECT SWITCHING AND LATCHING)

(PROVIDING $V_\ell - V_{DATA}$ DOES NOT EFFECT SWITCHING AND LATCHING)

(PROVIDING $V_\ell - V_{DATA}$ DOES NOT EFFECT SWITCHING AND LATCHING)

FIG. 6B

FIG. 7A
STROBE VOLTAGE AGAINST TIME
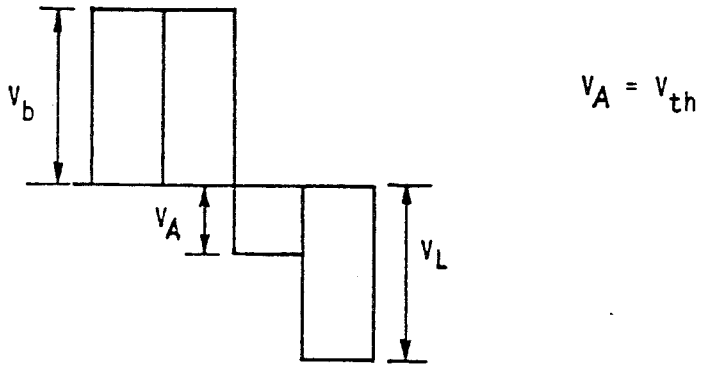
DATA VOLTAGES AGAINST TIME (SAME TIMESCALE) AND CORRESPONDING MODE
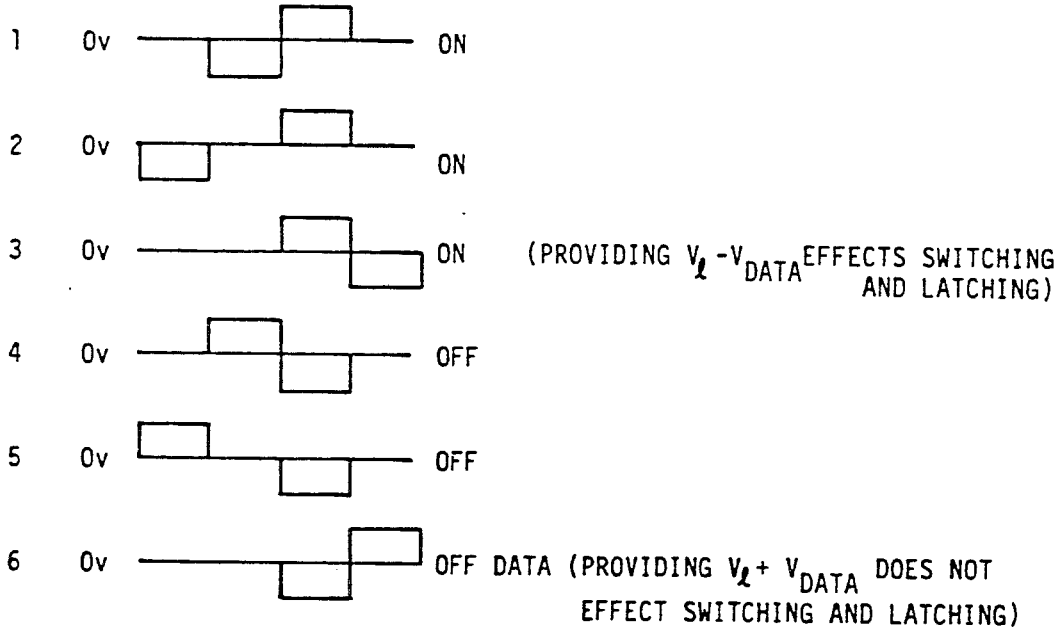
FIG. 7B

DATA ON

DATA OFF

LATCHES IN OPPOSITE STATE

STROBE

REMAINS IN BLANKED STATE

NON-STROBE

NO EFFECT

NO EFFECT

STROBE VOLTAGE AGAINST TIME
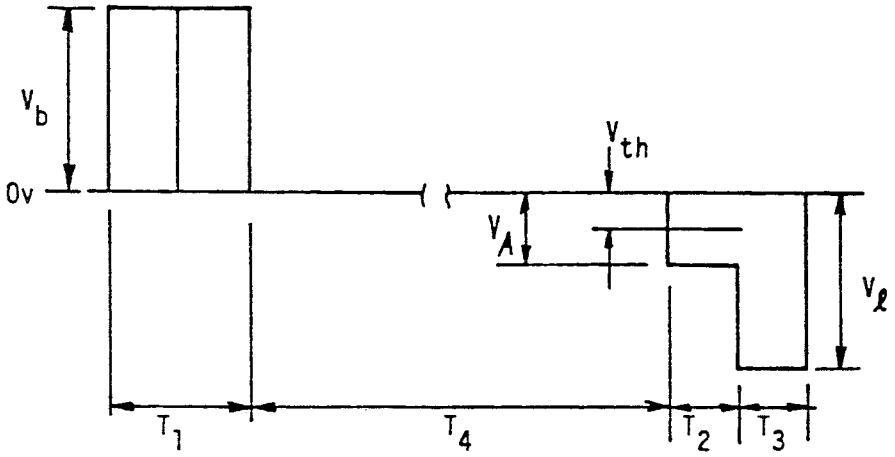
DATA VOLTAGES AGAINST TIME (SAME TIMESCALE) AND CORRESPONDING MODE
ON
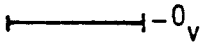
OFF
(PROVIDING $V_L+V_{DATA}$ DOES NOT EFFECT SWITCHING AND LATCHING)
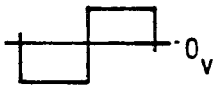
FIG. 9
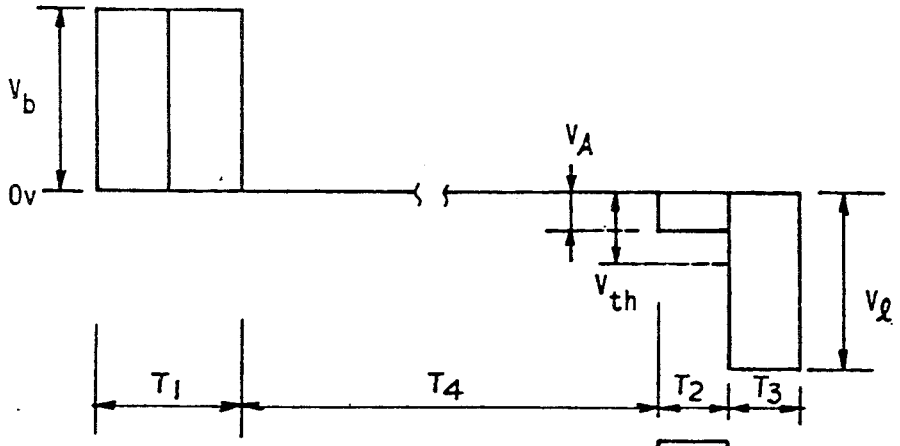
ON
(PROVIDING $V_L-V_{DATA}$ EFFECTS SWITCHING AND LATCHING)
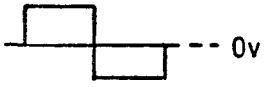
FIG. 10
OFF
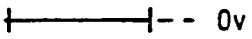

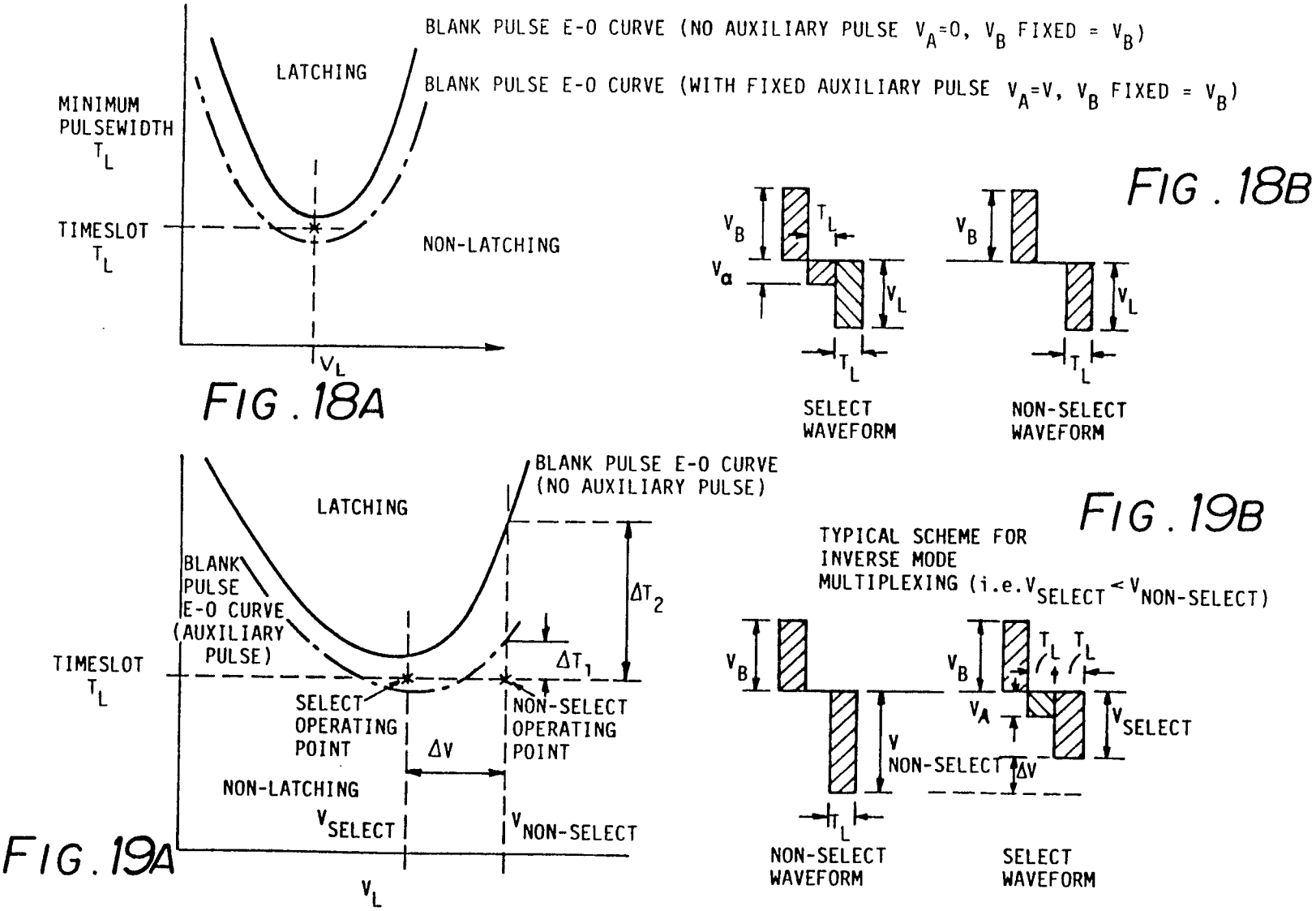
BLANK PULSE E-O CURVE (NO AUXILIARY PULSE $V_A$=0, $V_B$ FIXED = $V_B$)
BLANK PULSE E-O CURVE (WITH FIXED AUXILIARY PULSE $V_A$=V, $V_B$ FIXED = $V_B$)
LATCHING
NON-LATCHING
MINIMUM PULSEWIDTH $T_L$
TIMESLOT $T_L$
$V_L$
$V_B$
$V_a$
$T_L$
SELECT WAVEFORM
NON-SELECT WAVEFORM
BLANK PULSE E-O CURVE (NO AUXILIARY PULSE)
BLANK PULSE E-O CURVE (AUXILIARY PULSE)
$\Delta T_2$
$\Delta T_1$
NON-SELECT OPERATING POINT
SELECT OPERATING POINT
$\Delta V$
$V_{NON-SELECT}$
$V_{SELECT}$
TYPICAL SCHEME FOR INVERSE MODE MULTIPLEXING (i.e. $V_{SELECT} < V_{NON-SELECT}$)
$V_A$
V NON-SELECT
FIG. 18A
FIG. 18B
FIG. 19A
FIG. 19B

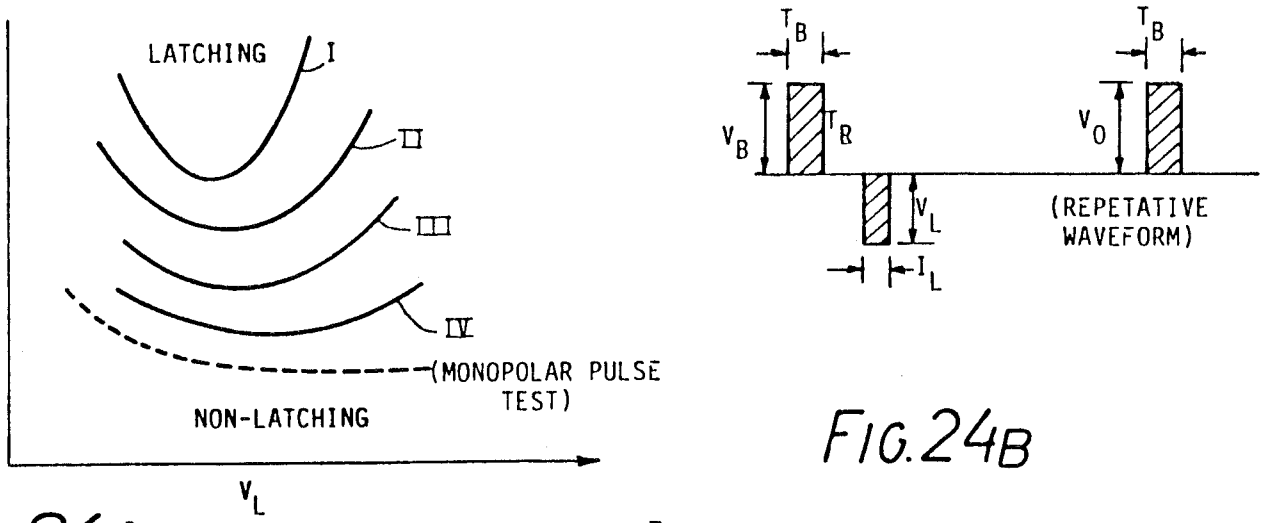
FIG. 24A
FIG. 24B
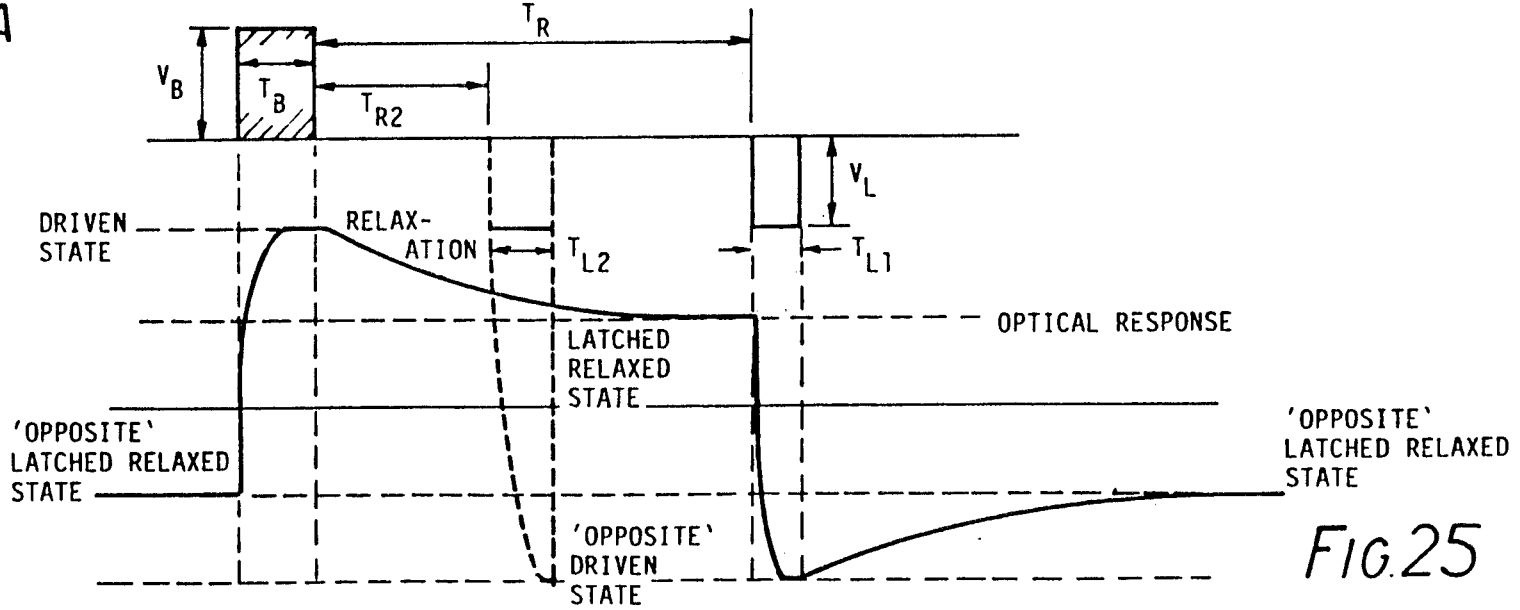
FIG. 25

DISPLAY DEVICE INCORPORATING SEPARATELY OPERABLE PIXELS AND METHOD FOR OPERATING SAME

The present invention relates to a liquid crystal display device, and particularly but not exclusively to one comprising a ferroelectric liquid crystal display. In particular the present invention relates to a method of addressing such a display device.

GB 2185614A (Canon) discloses a driving method for an optical modulation device, such as a liquid crystal display device. In a writing period for writing in all or prescribed pixels on a selected scanning electrode, the device is driven in three phases $t_1$, $t_2$, $t_3$. In the first phase $t_1$, a leading pulse is applied to ensure that a pixel is switched to a blanked state. In the third phase $t_3$, a trailing pulse of opposite polarity to the leading pulse is applied to effect switching out of that blanked state and latching into an opposite state when required. In the intermediate second phase $t_2$, a voltage is applied which does not affect the pixel state but which reduces the effect of cross-talk.

Figure 1:
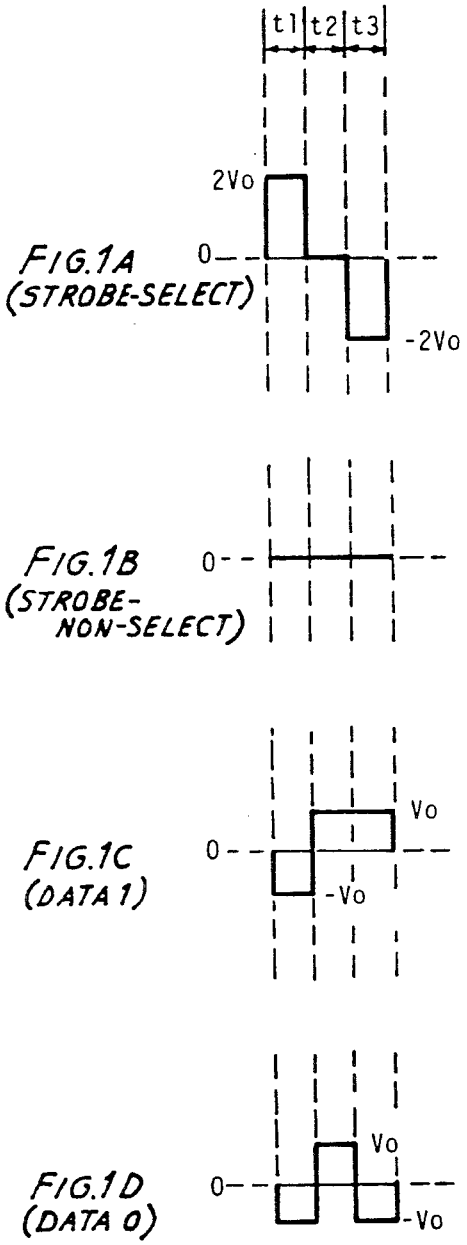
FIG. 1 (PRIOR ART)
Figure 2:
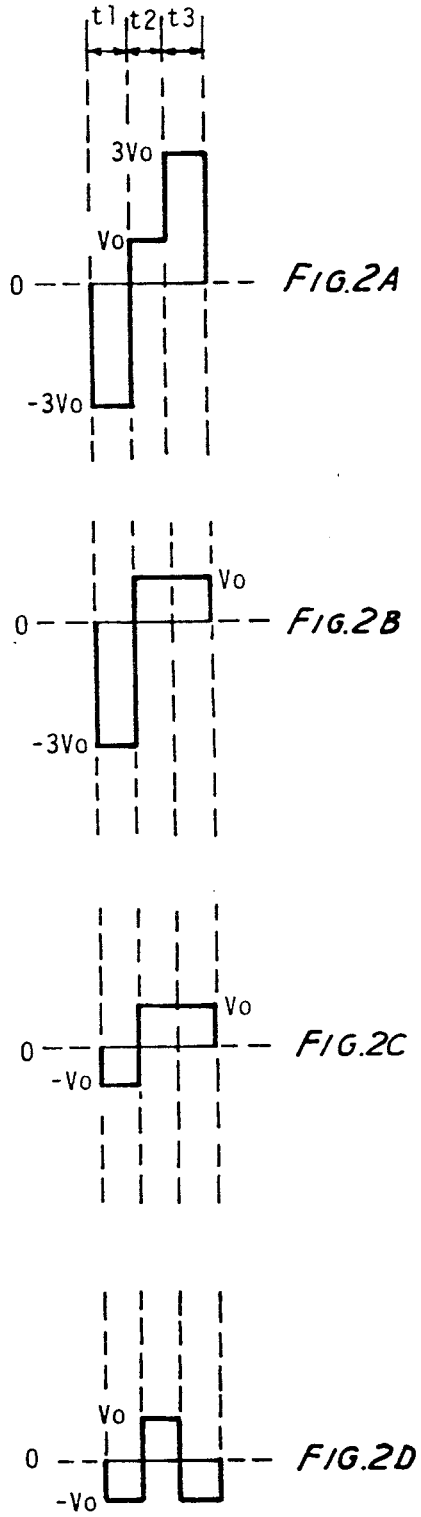
FIG.2 (PRIOR ART)
Figure 17A:
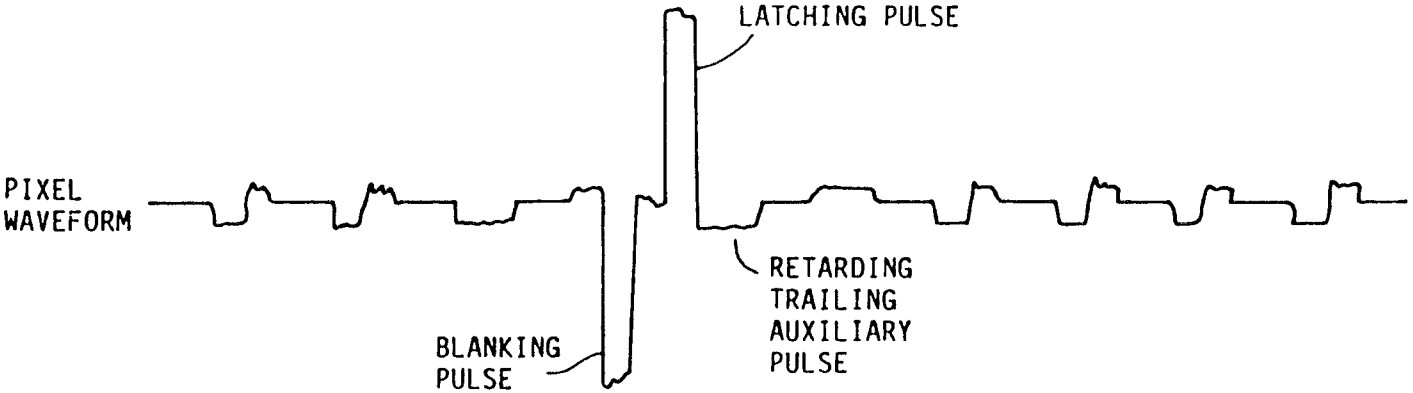
Figure 17B:
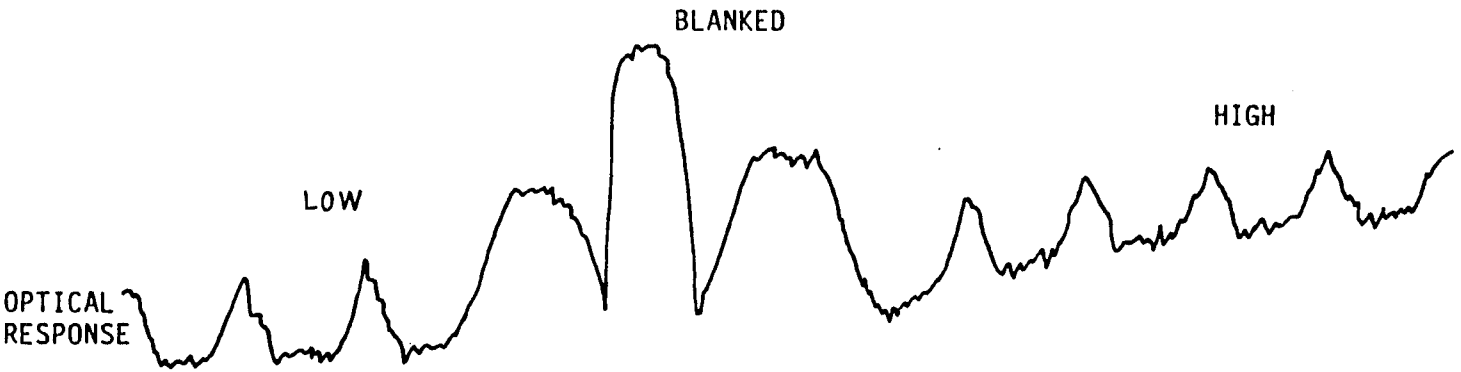

An example of a waveform scheme from GB 2185614A (FIGS. 17 and 18) is reproduced in FIGS. 1 and 2 of the present specification. FIGS. 1A, 1B, 1C and 1D show respectively the scanning (strobe) selection signal, the scanning (strobe) non-selection signal, the information selection (data 1) signal and the information non-selection (data 0) signal. FIGS. 2A and 2B show the resultant waveform produced across a pixel from the combination of the scanning selection signal and respectively the data 1 and data 0 signals. FIGS. 2C and 2D show the resultant waveform produced across a pixel from the combination of the scanning non-selection signal and respectively the data 1 and data 0 signals.

In the waveform of FIG. 2A, the trailing pulse is preceded by a voltage of the same polarity but of only one third the amplitude. This smaller amplitude pulse is produced by the data and not by the strobe waveform. The amplitude of the trailing pulse is increased by data "1" to effect switching out of the blanked state and decreased by data "0" so as not to effect switching out of the blanked state. There is no selective modulation of the amplitude of the smaller amplitude pulse, switching or non-switching being determined by modulation of the trailing pulse.

Modulation of the trailing pulse alone forces the ratio of the strobe and data voltages to be fixed in order to ensure that a non-switching trailing pulse can be achieved. The electro-optic characteristics of a ferroelectric liquid crystal device determine and limit the operating conditions (in terms of pulse voltage and width) for multiplexing. These conditions can be very limited for the voltage ratio given, or for any other fixed voltage ratio scheme. A further problem arises with the possibility of frequent occurrence of double width data pulses in the voltage train across any pixel while the rest of the device is being addressed, either due to the data 1 waveform or accidentally due to data 0 followed by data 1. In conventional schemes, this may result in significant crosstalk i.e. optical noise, thus reducing the device contrast. This accidental occurrence of data pulses forming double width data pulses is common in many multiplex schemes.

It is an object of the present invention to provide an improved method of addressing a liquid crystal display device.

According to the present invention there is provided a method of addressing a display device comprising a matrix of separately operable pixels, the method comprising the step of applying across a given pixel a voltage waveform comprising a latching pulse and an auxiliary pulse of amplitude smaller than the latching pulse, the amplitude of the auxiliary pulse being modulated to determine the latching effect of the latching pulse.

It has been found that more effective selective switching of a pixel from one state to another can be achieved by introducing an auxiliary voltage pulse in addition to the latching pulse with modulation of the auxiliary pulse determining the latching effect of the latching pulse. An advantage of the present invention is that a non-switching latching pulse can be achieved other than by reduction of the strobe voltage by data modulation to a data-sized voltage. The modulation of the auxiliary pulse alone can determine whether or not the latching pulse will switch. Consequently there is greater freedom to adjust the data and strobe voltage ratio, pulsewidth and voltage until a suitable set of waveforms for multiplexing is identified. As the present invention ensures that a wide choice of sets of data waveforms is available, it is readily possible to select sets of data waveforms which avoid double data pulses and minimize cross-talk.

Preferably the amplitude of the latching pulse is also modulated. This further enhances the discrimination between the two states of a pixel.

In the invention, the auxiliary pulse may be positioned before the latching pulse or after it and the auxiliary pulse may be immediately adjacent temporally the latching pulse or may be spaced temporally therefrom. Additionally or alternatively, there may be provided a further auxiliary pulse which need not be of the same amplitude as the first auxiliary pulse but must be smaller than the latching pulse.

In any of the above variants, preferably the one or more auxiliary pulses are of the same polarity as the latching pulse. However the auxiliary pulse need not be of the same polarity as the latching pulse. The amplitude and polarity of the auxiliary pulse depend on the data waveform used and the amplitude of the auxiliary pulse in much smaller than that of the latching pulse.

Preferably said voltage waveform includes a blanking pulse of opposite polarity to the latching pulse. The blanking pulse is of an amplitude and pulse width to switch a pixel into a blanked state. The combination of auxiliary pulse and latching pulse switches the pixel out of the blanked state when the data is 'ON' and does not switch the pixel out o the blanked state when the data is 'OFF'.

Preferably said voltage waveform is produced by simultaneously applying a strobe voltage waveform and a data voltage waveform across said given pixel, modulation of the auxiliary pulse being effected by the data voltage waveform.

Preferably, the method include strobing each row of the matrix only once per signal corresponding to an image for display.

Preferably, the method includes effecting temperature compensation by introducing a variable voltage component in the portion of the strobe voltage waveform corresponding to the auxiliary pulse; advantageously a variable voltage component is introduced in the portions of the strobe voltage corresponding to both the auxiliary pulse and the latching pulse.

It is preferred that the device exhibits a non-linear electro-optic characteristic with an up-turn (e.g. as shown in FIGS. 18 to 24 and 26). Such a device can be multiplexed, with this invention, in either the normal mode (magnitude of latching pulse greater when switching than when not switching) or the inverse mode (magnitude of latching pulse less when switching than when not-switching).

The present invention is applicable to colour displays and to monochrome displays.

The present invention also embodies equipment for the generation, and/or transmission, and/or reception and/or processing, of signals suited and/or designed for a device as herein defined.

Figure 3:
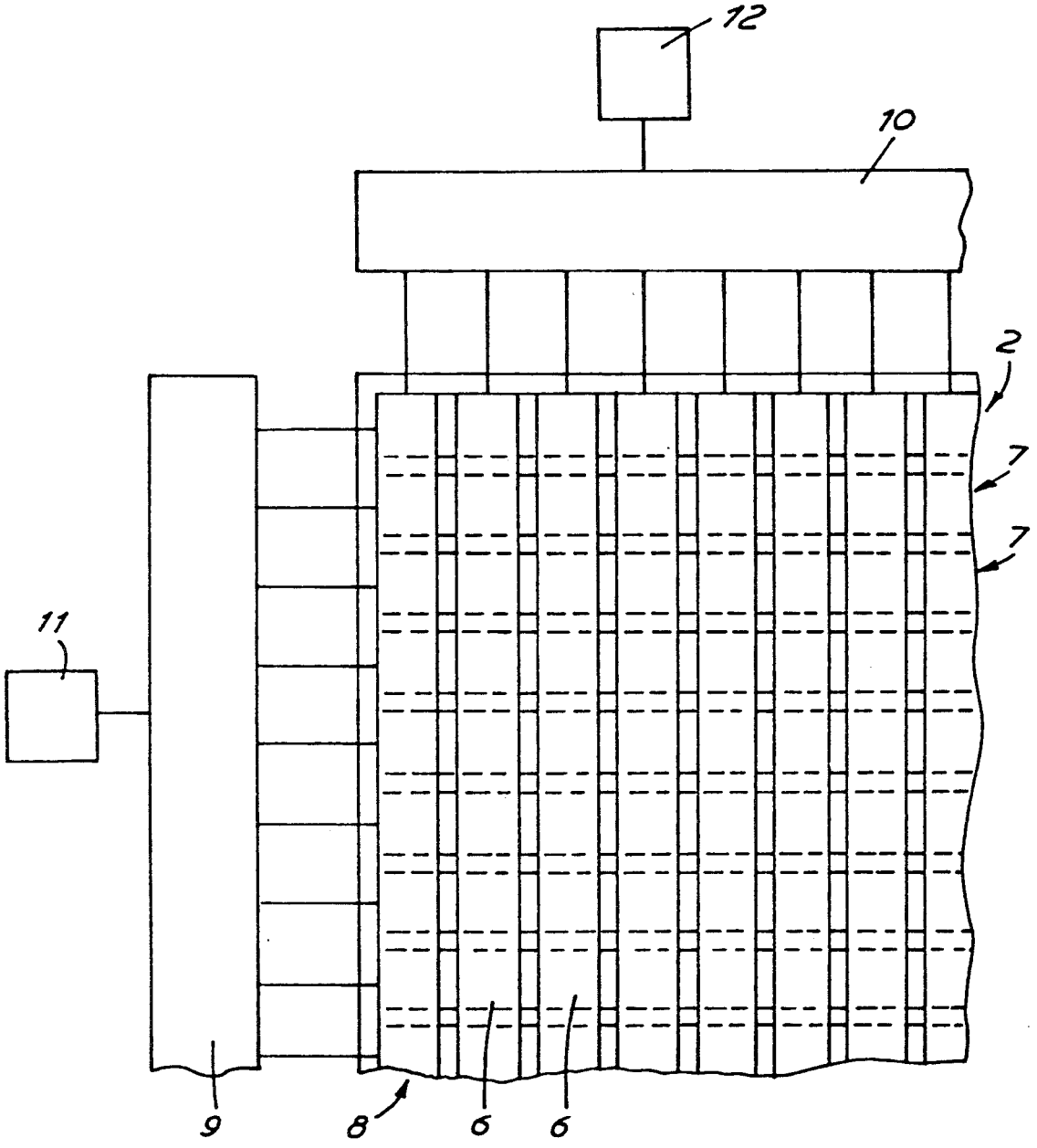
Figure 14A:
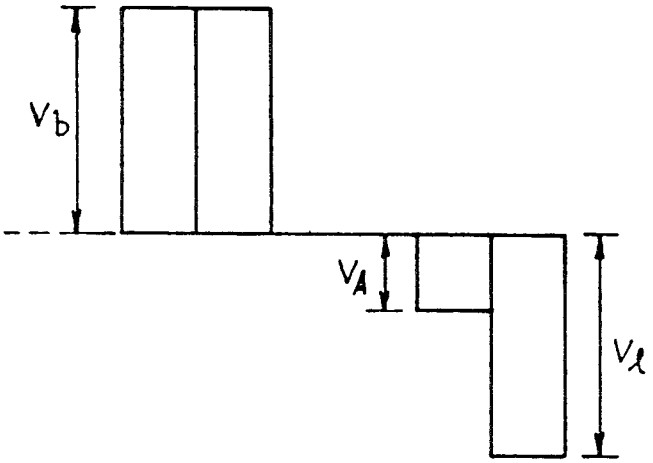
Figure 14B:
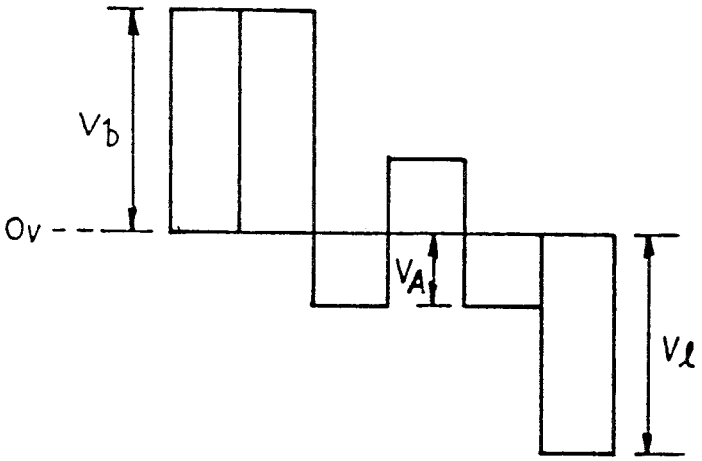
Figure 15:
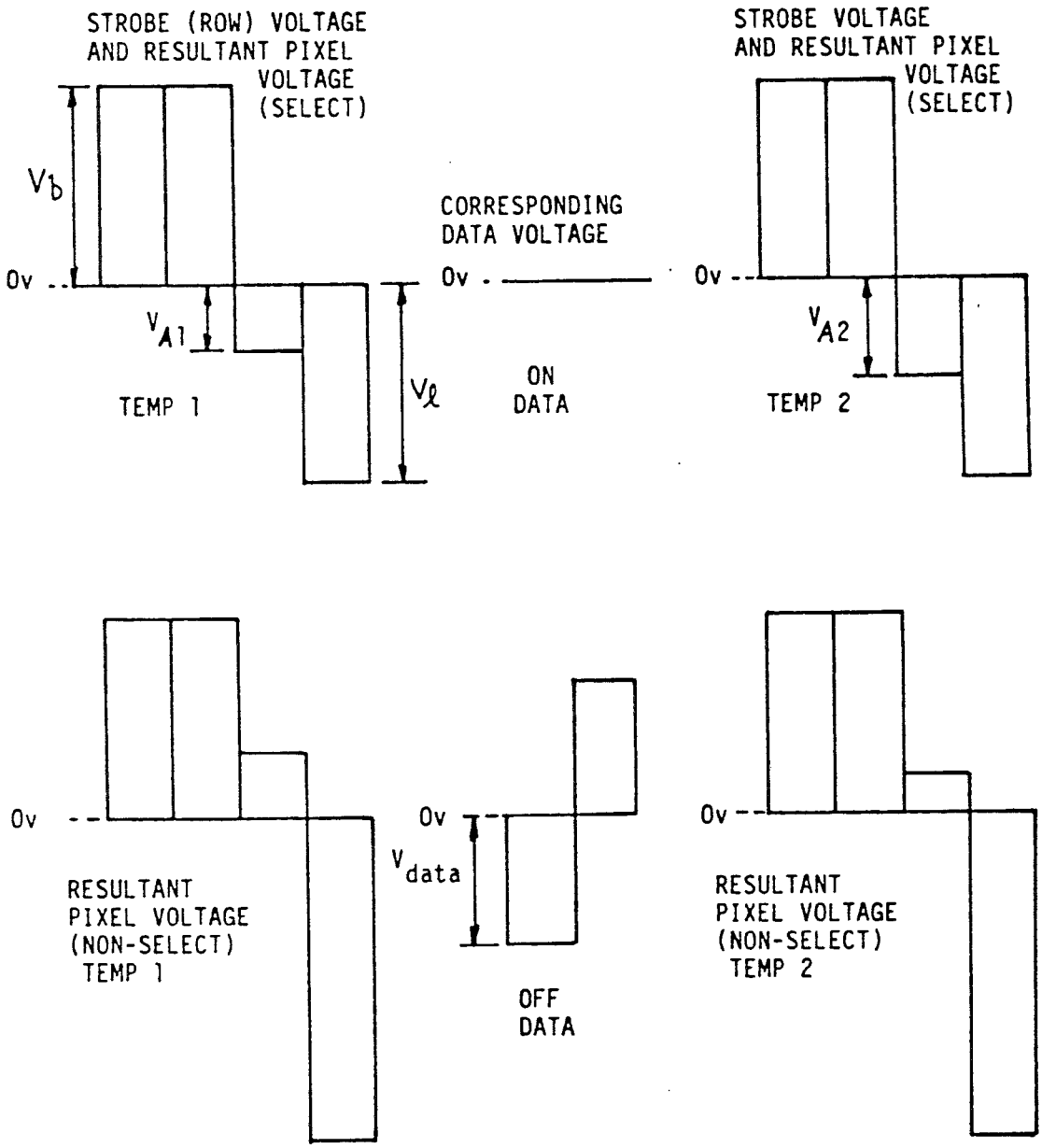
Figures 16A, 16B:
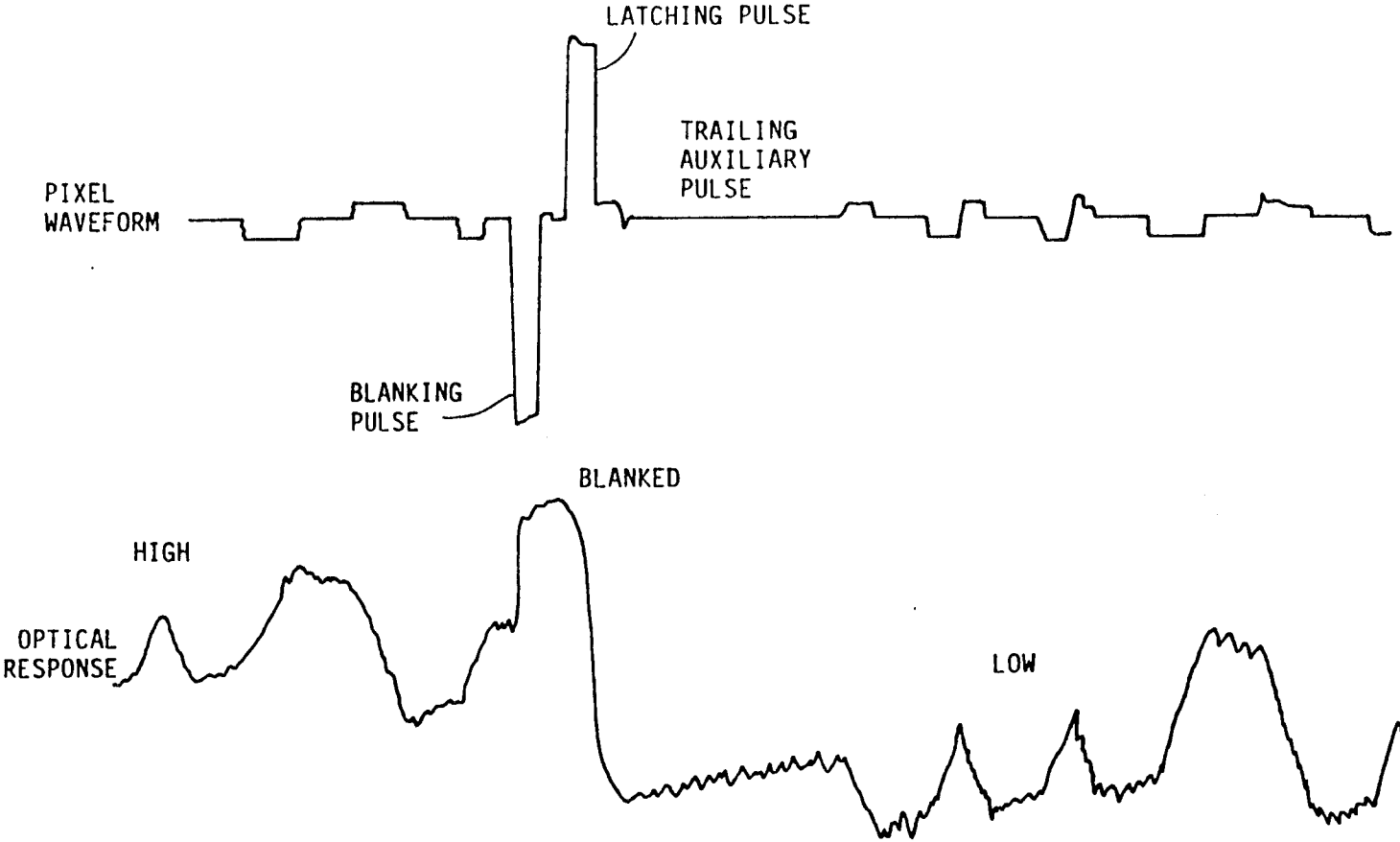
Figure 26:
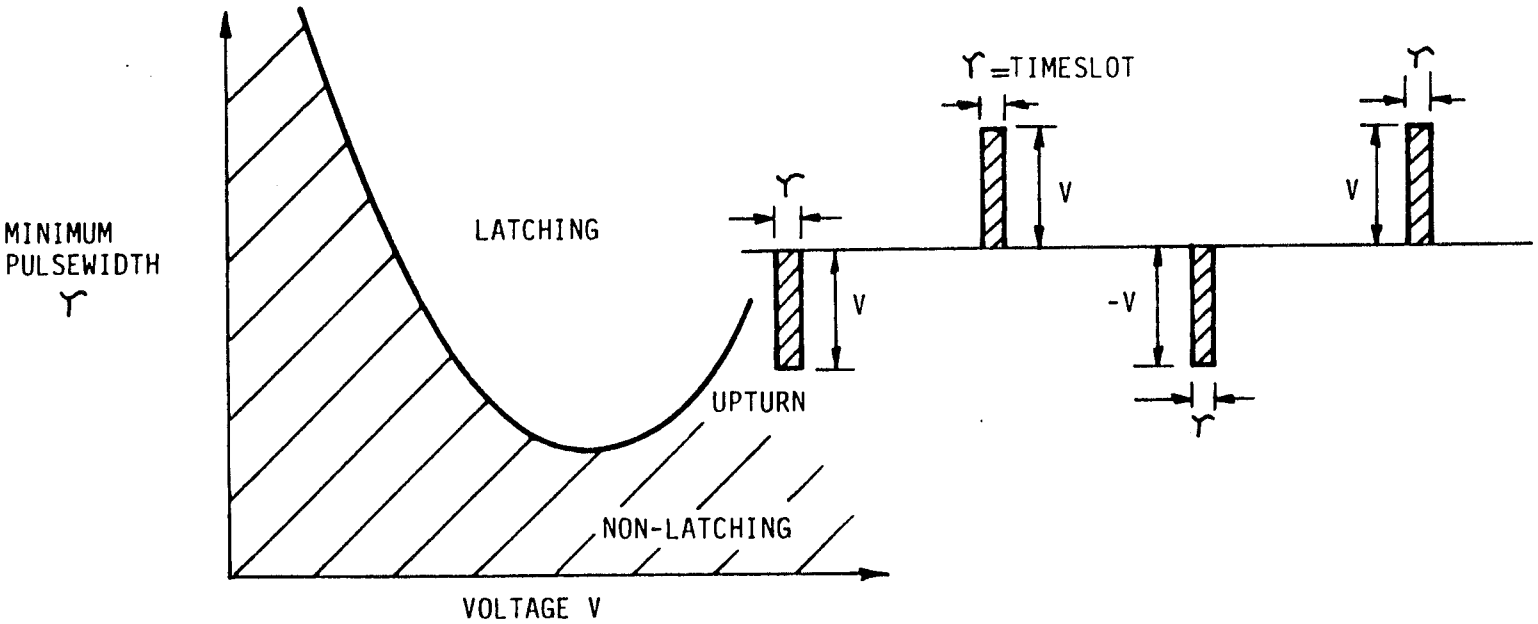

In order that the invention may more readily be understood, a description is now given, by way of example only, with reference to the accompanying drawings, in which:

FIGS. 1A-D and 2A-D show a scheme from GB 2185614A;

FIG. 3 shows schematically part of a display device;

FIGS. 4 to 5A-B, 6A-B, 7A-B, and 8A-H show multiplexing schemes embodying the present invention;

FIGS. 9 and 10 show corresponding line-blanking schemes embodying the present invention;

FIGS. 11A-B, 12A-B to 13 show electro-optic responses of the scheme of FIG. 9;

FIGS. 14A-B and 15 show further schemes embodying the present invention;

FIGS. 16A-B and 17A-B show electro-optic responses of two further schemes embodying the present invention;

FIGS. 18A-B, 19A-B to 24A-B, 25 illustrate characteristics of the present invention.

and FIG. 26 shows an electro-optic curve for a monopolar pulse.

FIG. 3 is a schematic plan representation of part of a matrix-array type liquid crystal cell 2 essentially comprising a layer of a ferroelectric liquid crystal material of thickness in the range of about from 1.5 to 3 μm are sandwiched between a first and a second layer of electrodes. Pixels 6 of the matrix are defined by areas of overlap between members 7 of a first set of row electrodes in the first electrode layer and members 8 of a second set of column electrodes in the second electrode layer. For each pixel, the electric field thereacross determines the state and hence alignment of the liquid crystal molecules. Parallel or crossed polarizers (not shown) are provided at either side of the cell 2. The orientation of the polarizers relative to the alignment of the liquid crystal molecules determines whether or not light can pass through a pixel in a given state. Accordingly for a given orientation of the polarizers, each pixel has a first and a second optically distinguishable state provided by the two bistable states of the liquid crystal molecules in that pixel.

Voltage waveforms are applied to the row electrodes 7 and column electrodes 8 respectively by row drivers 9 and column drivers 10. The shape of the voltage waveforms that may be applied by the row drivers 9 and the column drivers 10 is determined by waveform generators 11, 12 which may be computer-operated or may comprise solid-state circuitry. The matrix of pixels 6 is addressed on a line-by-line basis by applying voltage waveforms, termed strobe waveforms, serially to the row electrodes 7 while voltage waveforms, termed data waveforms, are applied in parallel to the column electrodes 8. The resultant waveform across a pixel defined by a row electrode and a column electrode is given by the potential difference between the waveform applied to that row electrode and the waveform applied to that column electrode. The row electrode to which a strobe waveform is being applied is termed the 'selected row' or 'selected electrode'. A 'data on' waveform applied to a pixel on a selected row causes the pixel to be put into one of the bistable states whereas a 'data off' waveform causes the pixel to be put into the other of the bistable states. Each electrode can therefore have one of two waveforms—strobe or non-strobe for each row electrode and 'data on' or 'data off' for each column electrode—applied thereto. Which of the two waveforms is applied is determined, in known manner, from the picture signal representing a picture for display.

Figure 4:
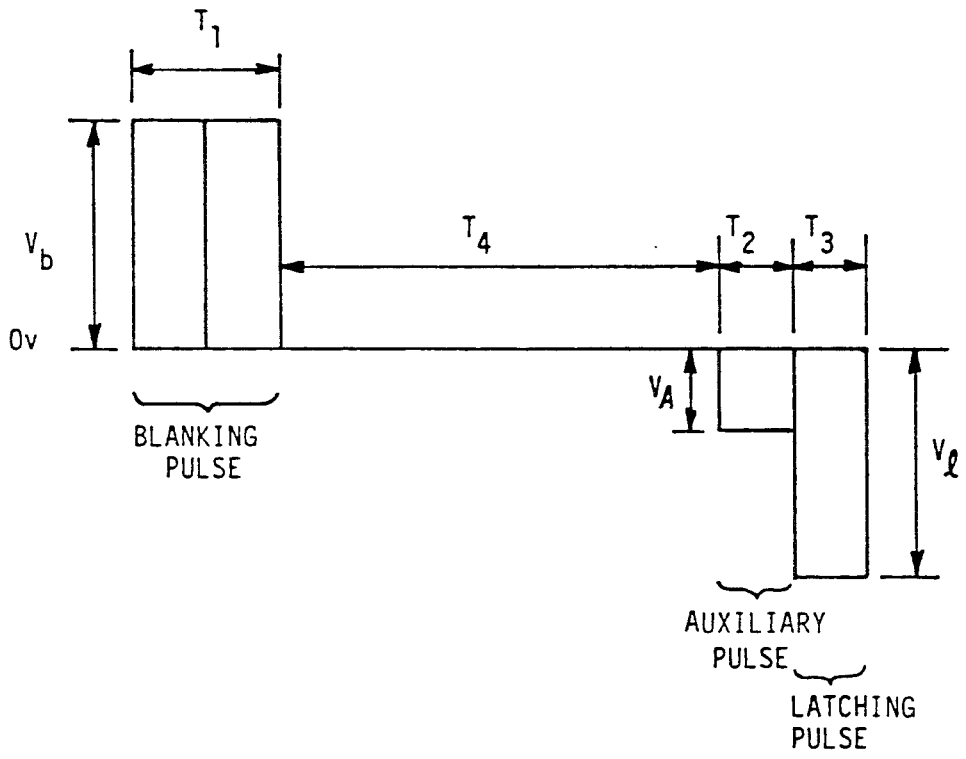
Figure 8A:
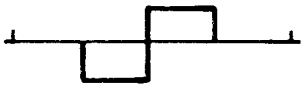
Figure 8B:
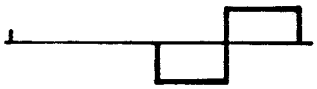
Figure 8C:
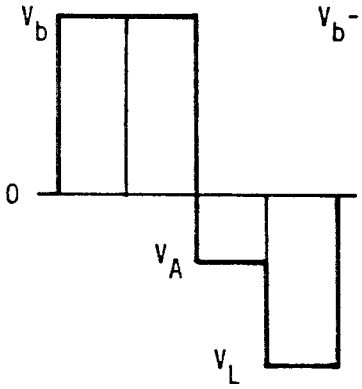
Figure 8D:
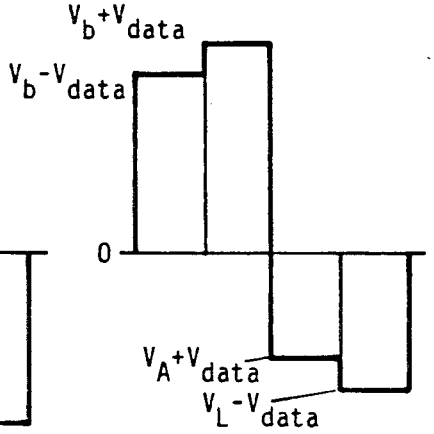
Figure 8E:
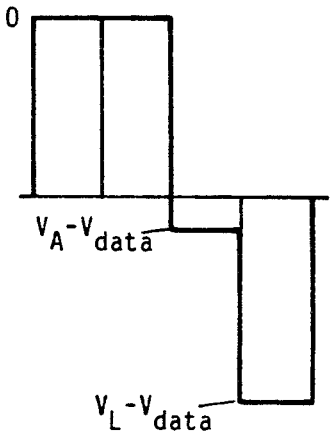
Figure 8F:
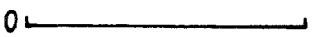
Figure 8G:
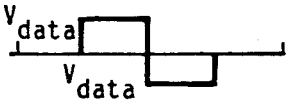
Figure 8H:
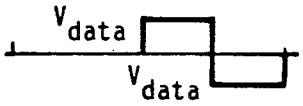

An example of a scheme, referred to hereinafter as the three-component voltage pulse scheme, embodying the present invention is illustrated in FIG. 4 which shows the resultant pixel waveform across a pixel. The three components are: a blanking voltage pulse; an auxiliary voltage pulse, and a latching voltage pulse.

The portion of the strobe waveform corresponding to the blanking pulse is chosen to have a sufficiently large voltage-time product to switch and latch the ferroelectric liquid crystal (FLC) molecules into a specified state regardless of their previous state and regardless of the effects of modulation caused by data voltage waveforms on the blanking pulse shape. (Accordingly, for clarity, the effect of data voltage modulation on the shape of the blanking pulse has not been shown.) This latched state is referred to as the blanked state.

For the first component, (i.e. the blanking pulse)

$$\int_{o}^{T_1} V_b \cdot dT$$

where T=0 is defined in the time at the beginning of the blanking pulse, is chosen to be sufficient to switch and latch into the blank state, independent of any data modulation and additional pulses that appear on the sides of the blanking pulse due to data modulation (referred to as parasitic pulses). Also, for "data on", $$\int_{o}^{T_2} V_A \cdot dT + \int_{o}^{T_3} V_1 \cdot dT$$

is sufficient for the pixel to switch from the blanked state and to latch into the opposite state. For "data off", $$\int_{o}^{T_2} V_A \cdot dT + \int_{o}^{T_3} V_1 \cdot dT$$

is insufficient for the pixel to be unlatched from the blanked state. (For each integral, T=0 is defined as the time at the beginning of that voltage component.) For on/off data, $V_A$ is modulated by data above and below, respectively, a threshold voltage $V_{th}$. $V_{th}$ is defined as the magnitude of the auxiliary pulse necessary for the combination of the auxiliary and latching pulses to switch the pixel out of the blanked state and latch it into the opposite state. The time interval $T_4$ can be zero or it can have a positive value; it may contain voltage pulses providing they are not such as to interfere with the function of the three components. The waveform of the three components may take any appropriate form providing that the three integration conditions above are satisfied.

It has been found that more efficient switching from one state to another can be achieved by introducing an auxiliary voltage pulse just prior to the latching pulse of the same polarity. An auxiliary voltage pulse of the opposite polarity will inhibit switching. By careful choice of pulse height and width for both the auxiliary pulse and the latching pulse, it is possible to aid or prevent switching and latching by modulating the auxiliary pulse alone with the data voltage waveforms. It is this feature which is embodied in the second and third components of the multiplex scheme of the present invention. Although it is preferably to arrange for the auxiliary pulse to be just prior to the latching pulse with no time separation between the two components, this feature can still be obtained if the scheme is modified, such as if the order of the components is reversed, or time intervals or fixed voltage pulses are introduced between the two components. However, loss of performance in terms of switching speed and width of the multiplex operating conditions window can occur if the scheme is so modified.

Component three, i.e. the latching pulse, is arranged to be of the opposite polarity to the blanking pulse. Component two, the auxiliary pulse, and the latching pulse are chosen such that during 'on' data modulation the FLC molecules are switched out of the blanked state and latched into another state referred to as the 'opposite state'. During 'off' data modulation the FLC molecules remain latched int he blanked state. Good high contrast multiplexing can be obtained by modulating the auxiliary pulse alone, without modulating the latching pulse as is used in most multiplexing schemes. Modulation of the latching pulse in addition to the release pulse is optional but can be used if required to improve the discrimination and the width of the operating window.

Clearly, a blanking pulse of a single slot width, rather than two slots as shown, can be used provided the pulse satisfies the requirements for a blanking pulse. In this way, the line address time for the four-slot version of FIG. 4 is reduced by 25% to give a three-slot version, providing a useful increase in display speed.

In FIGS. 5, 6 and 7, a number of simple 'n-timeslot' multiplex schemes are shown which embody the above requirements. In each of these Figures, a strobe voltage waveform has been shown together with a number of data voltage waveforms which can be used to modulate the strobe voltage waveform. The mode given for each data voltage waveform indicates if the waveform is a 'data on' or a 'data off' waveform for the strobe voltage waveform shown.

The number of timeslots between the blanking pulse and the auxiliary pulse can be almost unlimited as long as any intermediate voltage pulses due to the strobe waveform or data modulation do not unlatch the device from its blanked state nor interfere with the combined actions of the auxiliary and latching pulses. It is preferable that all the data set are DC-compensated although non-compensated sets can be used provided this does not degrade the device performance. The strobe (or row) voltage is not usually compensated. To ensure complete DC compensation the scheme voltages can be inverted in a regular periodic manner for example after every row of the display has been addressed i.e. after each frame. For optimum performance with high contrast, it is preferable that data sets are chosen such that parasitic pulses do not appear on the trailing side of the latching pulse as this might interfere with the discrimination between the select and non-select latching pulses. Also, it is preferable that double pulses and consecutive data pulses of the same polarity are avoided in the data wavetrain, in order to ensure that optical noise due to the data is minimized and the pixel does not become unlatched due to any over-sized VT product. Data sets, i.e. combinations of 'data on' and 'data off' waveforms, satisfying these conditions for the above schemes are as follows: for the scheme of FIG. 5, sets (1,9), (1,11), (2,11), (3,11), (4,11), (5,11), (6,9), (8,9); for the scheme of FIG. 6, sets (1,4), (1,7), (1,10), (1,11), (2,4), (2,7), (2,10), (2,11), (3,4), (3,5), (3,9); for the scheme of FIG. 7, sets (1,6), (2,6), (3,4). FIG. 8 shows the multiplex scheme produced by the combination of the strobe waveform of FIG. 5 and the data set (2,11) of FIG. 5.

The three component scheme can be adapted and implemented as a line-blanking scheme. The rows of a display are strobed by a unipolar blanking pulse with identical properties to the blanking pulse described above. Hence all the pixels in all rows that have been strobed by the blanking pulse are switched into a fixed and identical state known as the blanked state regardless of the column data voltage. Another unipolar pulse of opposite polarity is strobed down the rows a fixed number of lines behind the blanking pulse. The data voltage pulses are arranged to combine with this second strobe voltage in such a manner that the resultant pixel voltage either switches the pixel out of the blanked state and latches it into the opposite state or leaves the pixel in its blanked state. A two-timeslot line-blanking scheme is illustrated in FIG. 9. This scheme corresponds to that shown in FIG. 5 with the data set (1,11), but modified to operate as a two-slot blanking scheme. The first component, the blanking pulse, is strobed one to n lines ahead of the combined auxiliary and latching pulse. During operation, it must satisfy the requirements of the general scheme of FIG. 5, and $$V_A > V_{th};$$

$$V_{data} > (V_A - V_{th})$$

$$T_1 = T_2 + T_3 = \textit{two time slots.}$$

$$T_4 = (2 \times \textit{integer}) \text{ time slots.}$$

$V_{th}$ depends upon data in timeslot prior to auxiliary pulse and also the time interval between blanking and auxiliary pulse, i.e. the number of lines blanked. Accordingly, $V_{th}$ varies with the voltages produced across a pixel by "off" and "on" cross-talk data voltages prior to the auxiliary pulse; the scheme voltage pulses must be selected to satisfy the variation in $V_{th}$ to ensure that no unwanted crosstalk occurs between neighbouring pixels in the same column.

FIG. 10 shows another line-blanking scheme which corresponds to the multiplexing scheme of FIG. 6 with the data set (3,4), but modified for line-blanking. The following conditions apply:

$$V_A < V_{th};$$

$$V_{data} > (V_{th} - V_A);$$

$t_1 = T_2 + T_3$ = two time slots; $T_4 = (2 \times integer)$time slots;

$V_A$ may be positive or negative voltage.

Figure 11A:
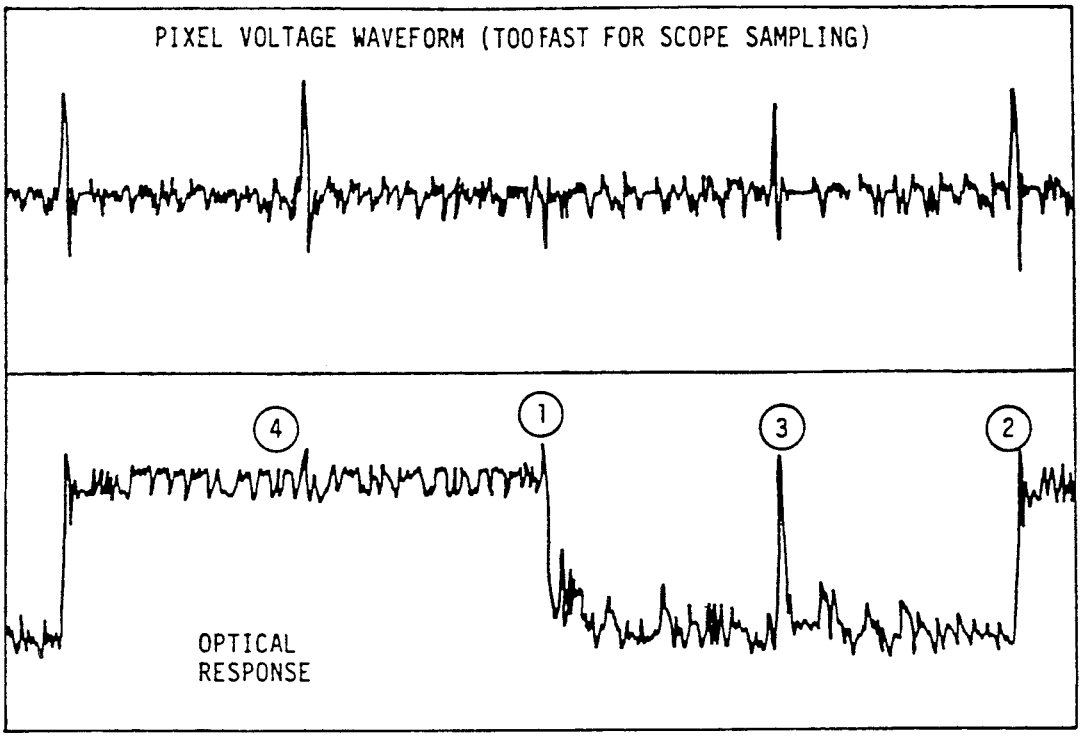
Figure 11B:
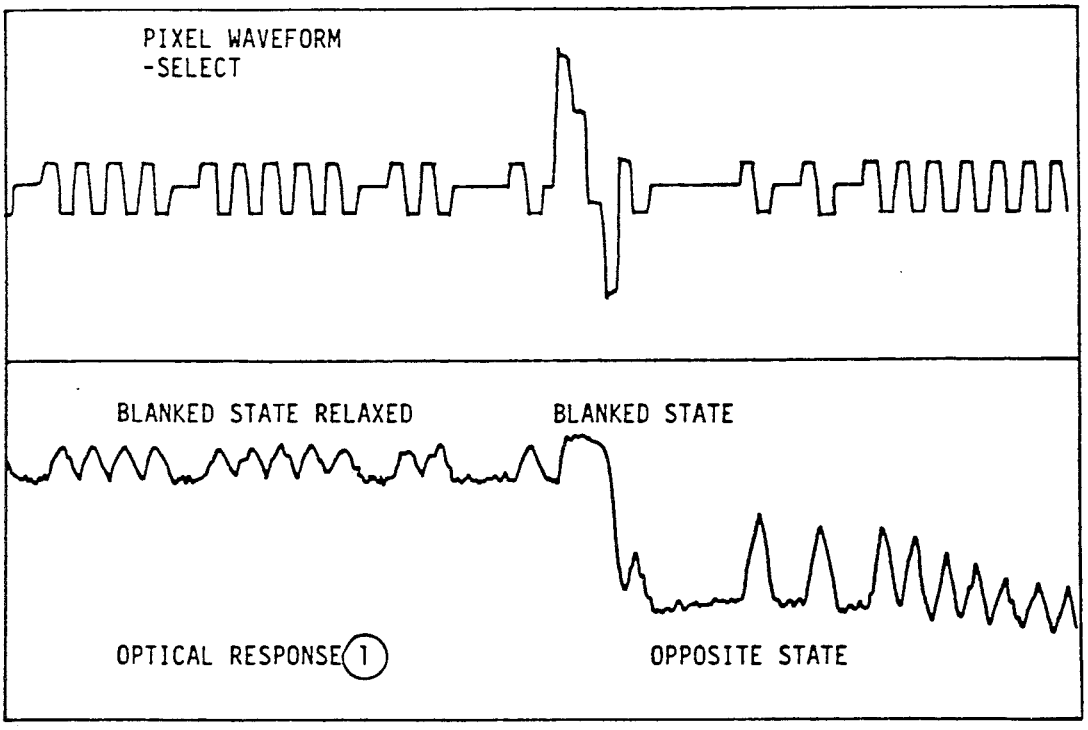
Figure 12A:
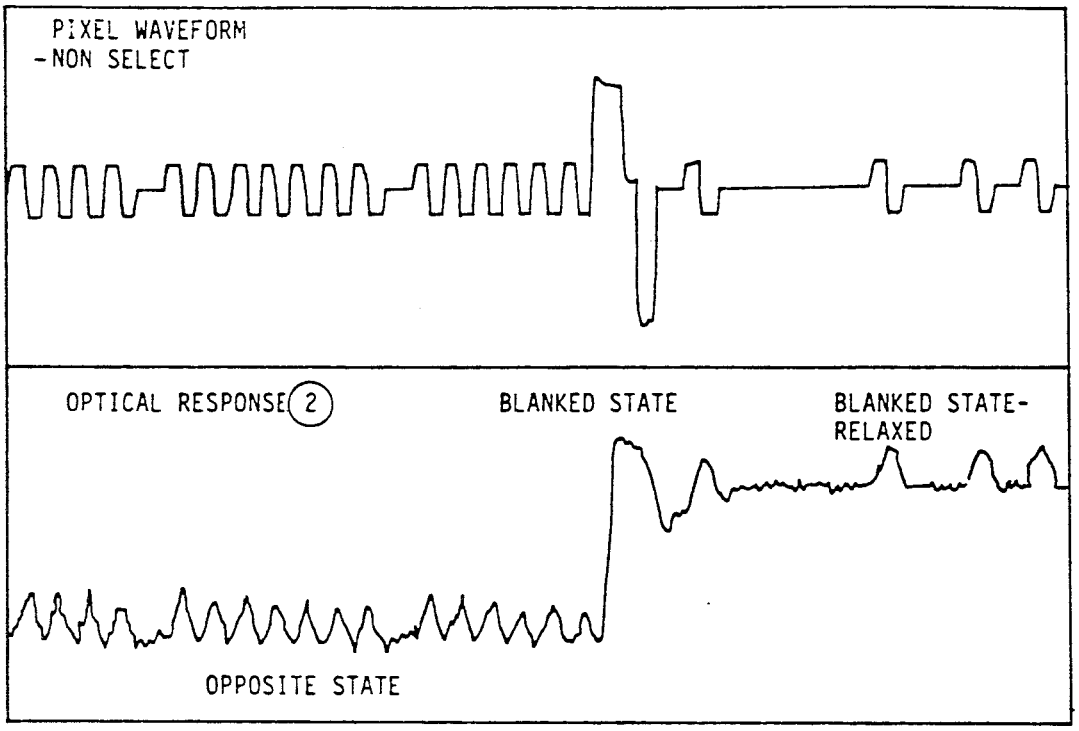
Figure 12B:
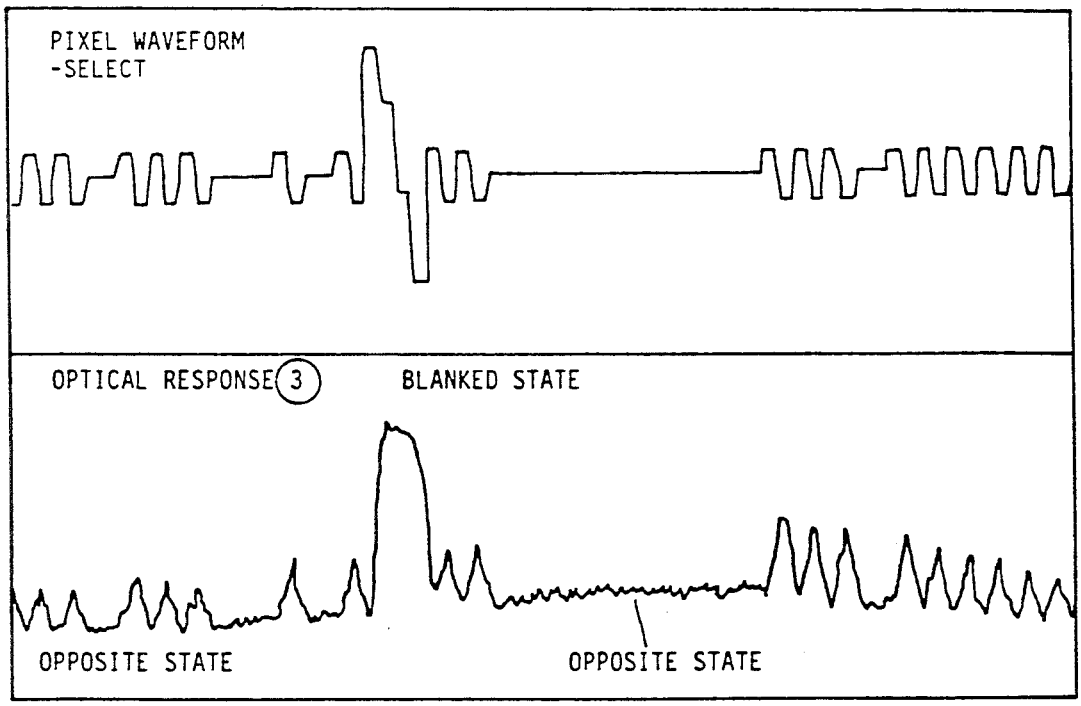
Figure 13:
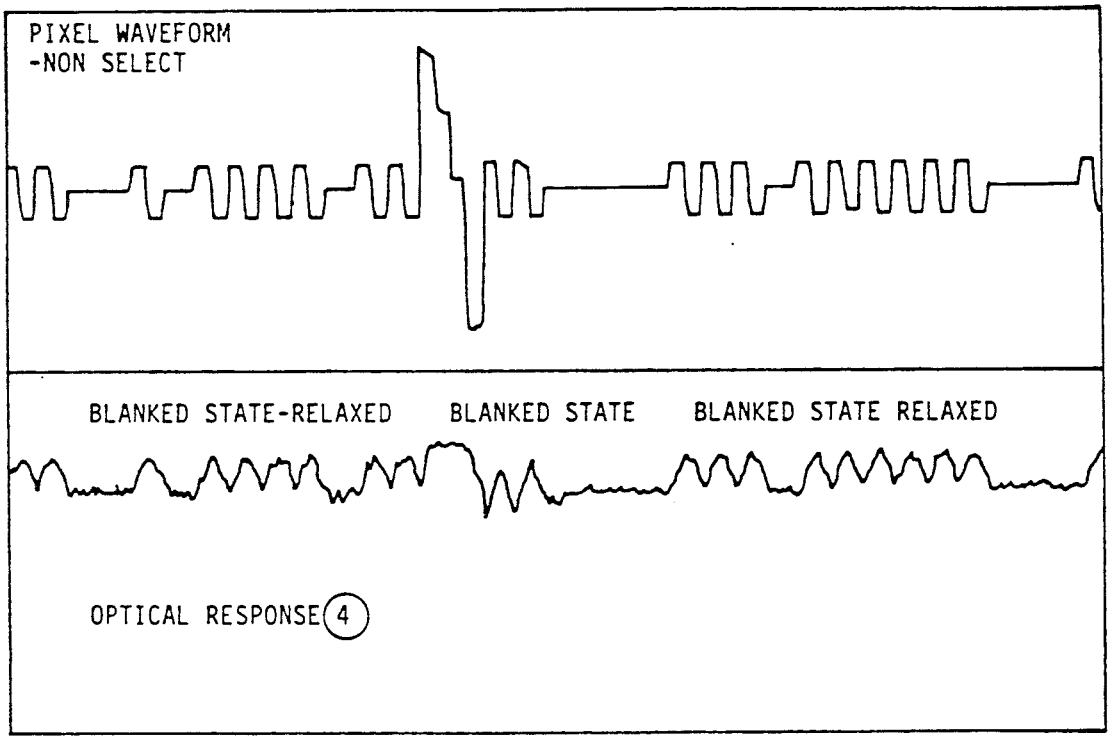

FIGS. 11, 12 and 13 are examples of the electro-optic response during multiplexing using the scheme of FIG. 9 for the case where blanking occurs one line ahead of the data addressed line. FIGS. 11*b*, 12*a*, 12*b* and 13 show the electro-optic response around respectively the points 1, 2, 3 and 4 of FIG. 11*a*. This scheme can be used in the n-line blanked mode if required. The data set satisfies the requirements for optimizing the multiplex performance. In addition no parasitic pulses appear on the trailing side of the latching pulse interfering with the discrimination between the select and non-select latching pulses.

One advantage of an 'n-lines' blanked or a multi n-slot scheme is that some time is allowed for the FLC molecules to relax from the fully driven and blanked state to a blanked but relaxed state prior to the application of the auxiliary and latching pulses. Consequently narrower auxiliary and latch pulsewidths can be used to switch from the relaxed to the opposite state. Thus an increased number of lines may be addressed in the display for a given time providing the number of slots required in the scheme have not increased by more than the proportional increase in addressing speed. FIGS. 14*a* and 14*b* each show an n-slot schemes, i.e. a scheme in which the waveform takes up more than four slots, designed to allow some relaxation to occur after the blanking pulse in order to reduce the width of the timeslot. Any chosen voltage pulses between the blanking pulse and the auxiliary and latching pulses must be such as to not interfere with the fundamental operations of the addressing scheme. Any of the schemes of FIGS. 5, 6 and 7 can be used as the sequence of blanking, auxiliary and latching pulses.

A useful advantage of the three component scheme is that some temperature compensation may be readily implemented by introducing a variable voltage component into the auxiliary pulse timeslot part of the strobe voltage (i.e. the portion of the strobe voltage corresponding to the auxiliary pulse) thereby to alter the efficiency of the action of the auxiliary pulse to counter the effect of changes in temperature (see FIG. 15). This is used to compensate for and avoid shifts in the data addressing frequency, data voltage, blanking and latching voltage that are often required to maintain multiplexing as the temperature varies. The amount of temperature compensation possible depends greatly upon the liquid crystal material and device parameters; however, a temperature variation of a few degrees centigrade can readily be achieved for most materials by use of the above method. For temperature compensation over a wider range, an additional adjustable voltage component can be introduced into the strobe latching pulse component.

In the illustrated example, temperature 1 is greater than temperature 2, and $V_{A1}$ is less than $V_{A2}$ to compensate for the difference in temperature. In this way, $V_{data}$, $V_l$, $V_b$ and the pulse width can be kept constant during multiplexing. Data modulation has been removed from the blanking pulse in this illustration for clarity.

FIGS. 16 and 17 relate to a scheme using a trailing auxiliary pulse. There is no data modulation of the latching pulse. Thus all switching is determined by the auxiliary pulse alone. From the shown results it is clear that time intervals and other fixed intermediate pulses between the auxiliary pulse and the latching pulse are permissible providing they do not interfere with the mechanism causing switching by the auxiliary pulse. The relative position of the auxiliary pulse and latching pulse is not critical for obtaining multiplexing, but it does have a significant effect on the speed and width of the multiplex operating window conditions. These observations highlight the sensitivity of the system to the effect of neighbouring pixel data (crosstalk) following the latching pulse. It is still preferable to position the auxiliary pulse immediately prior to the latching pulse and modulate both with data. This ensures optimum speed and wide operating conditions, the effect of any trailing neighbouring pixel data causing crosstalk is then minimized. The addition of a trailing auxiliary pulse as well as the normal auxiliary pulse, so that the latching pulse is sandwiched between two identical pulses modulated in phase with each other, can be used to back up the preferred scheme (at the expense of an additional timeslot) to widen out the operating conditions even further.

It is believed that a device embodying the present invention achieves the desired effect by the auxiliary pulse causing depending of the blanking pulse electro-optic curve. (The blanking pulse electro-optic curve describes the ability of a given voltage pulse or pulse sequence to switch and latch a pixel out of the blanketed state.) FIG. 18 shows the curves due to the introduction of a simple auxiliary pulse prior to the latching pulse such as can be provided by data modulation. Thus it is possible to shift the e-o characteristic up and down the pulsewidth axis by modulating the auxiliary pulse. An auxiliary pulse with the same polarity as the latching pulse shifts the e-o curve 'down', i.e. faster switching. A auxiliary pulse with opposite polarity to the latching pulse retards switching and hence shifts the curve 'up', i.e. slower switching. Correct choice of the latching pulse voltage $V_L$, width $T_L$ and auxiliary pulse modulation voltage (data voltage) enables multiplexing to occur.

FIG. 18 shows the curves for $V_B$ and $V_a$ fixed, while $T_L$ (timeslot) and $V_L$ (multiplex operating point) are chosen such that, when $V_A=0$, no latching occurs (below "no auxiliary pulse" curve), when $V_A=V_a$ latching occurs (above "fixed auxiliary" curve).

By combining both auxiliary pulse and latching pulse modulation in a multiplex scheme as shown in FIG. 19 is possible to obtain very good discrimination between the selected and non-select states and to obtain good wide multiplexing operating condition windows. A measure of the discrimination between select and non-select switching is the time between the non-select operating point and the no auxiliary pulse e-o curve i.e. $\Delta T_2$. The use of an auxiliary pulse effectively increases the discrimination by $\Delta T_1$.

Figure 20:
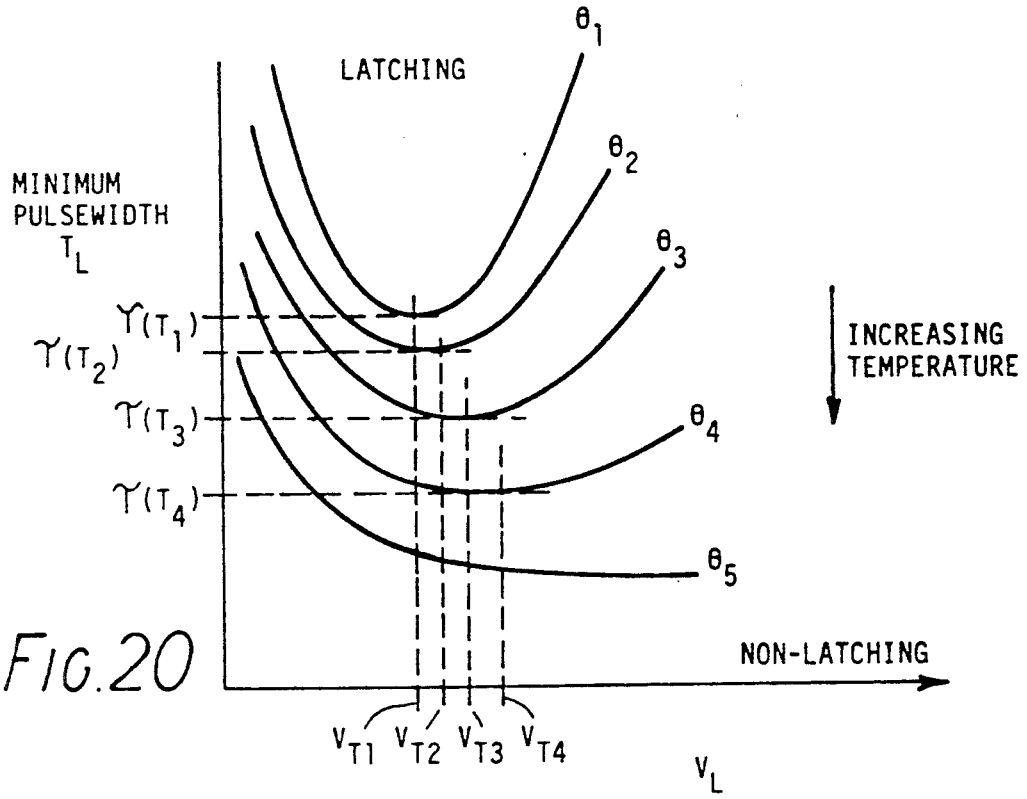

FIG. 20 shows the effect of temperature on the blanking pulse electro-optic characteristic obtained with $V_A=0$ for various values of temperature $\theta$, and so on where $\theta_1<\theta_2<\theta_3<\theta_4<\theta_5$. Several important features are to be noted: first, the minima in the curve deepens with increasing temperature, i.e., the e-o response is faster; second, the minima voltage increases with temperature; thirdly, the steepness of the upturn in the e-o curve decreases with temperature increase. These changes in the e-o curve with temperature have a significant effect on the voltages required for multiplexing and the discrimination between the select and non-select multiplex states.

In order to ensure the device can be multiplexed over some temperature range at a constant addressing rate, it is necessary for the latching pulse voltages to 'track' the e-o characteristics, with temperature variation, to ensure that the select and non-select pulses lie in a switching and non-switching region respectively of the e-o characteristic. Hence by applying a variable voltage component to the auxiliary pulse slot independent of the data modulation of the auxiliary pulse it is possible to obtain some degree of temperature compensation by simply shifting the e-o curve up and down the pulse-width axis.

Figure 21:
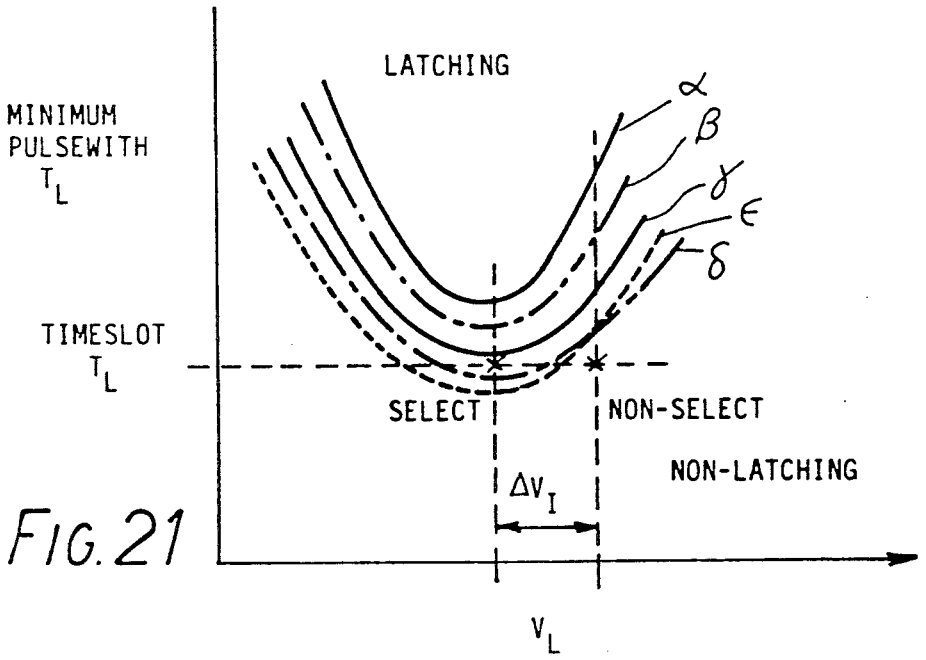

FIG. 21 shows a series of blanking pulse e-o curves such that the curve $\alpha$ relates to no auxiliary pulse at a temperature $\theta_1$; curve $\beta$ relates to an auxiliary pulse $V_{a1}$ at the temperature $\theta_1$; curve $\gamma$ relates to no auxiliary pulse at a temperature $\theta_2$ (with $\theta_2>\theta_1$); curve $\delta$ relates to an auxiliary pulse $V_{A1}$ at temperature $\theta_2$; and curve $\theta$ relates to an auxiliary pulse $V_{A2}$ (with $V_{A2}>V_{A1}$) at temperature $\theta_1$. Thus, it can be seen that by increasing the auxiliary pulse voltage as temperature decreases, or vice versa, the e-o curve is maintained so that select operating point still latches and non-select does not. For temperature shifts involving significant variation in the minimum m voltage it is necessary to apply an independent voltage component to the latching pulse slot to ensure good tracking of the e-o curve.

Figure 22:
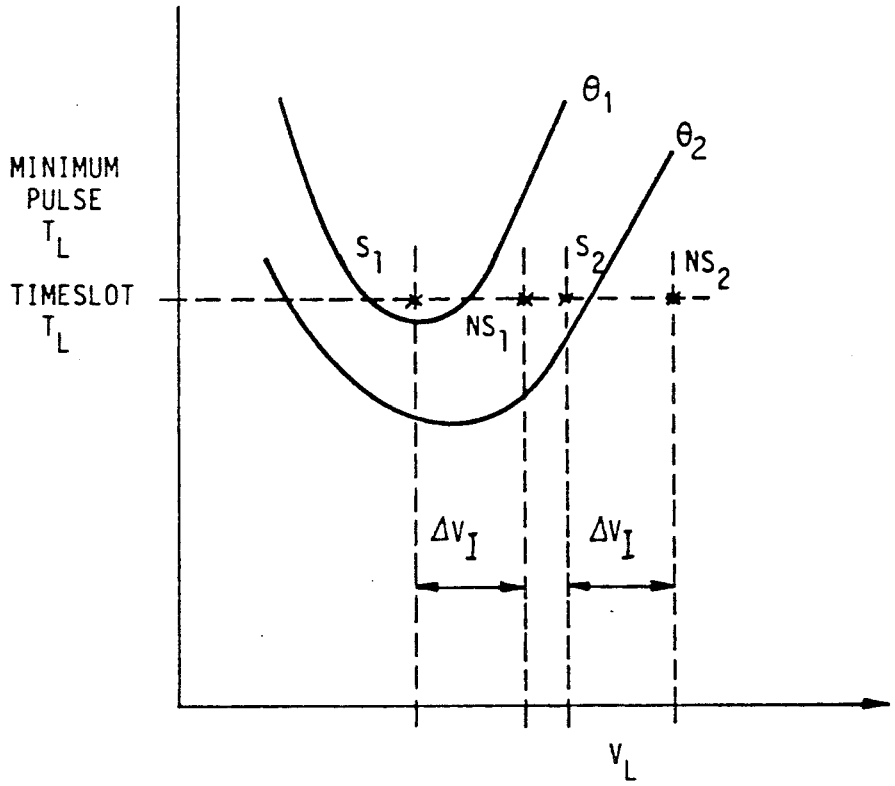

FIG. 22 shows e-o curves indicating temperature compensation using a latching pulse component, such that $S_1$ is the select operating point at $\theta_1$, $NS_1$ is the non-select operating point at $\theta_1$, $S_2$ is the select operating point at $\theta_2$ and $NS_2$ is the non-select operating point at $\theta_2$, with $\theta_2$ being greater than $\theta_1$. The minimum timeslot, hence maximum addressing rate, of the device is determined by the e-o curve for the lowest temperature at which the device is to operate. Consequently it is beneficial to use a combination of both latching pulse and auxiliary pulse temperature compensation to ensure a 'faster' e-o curve at the lowest temperature.

Figure 23:
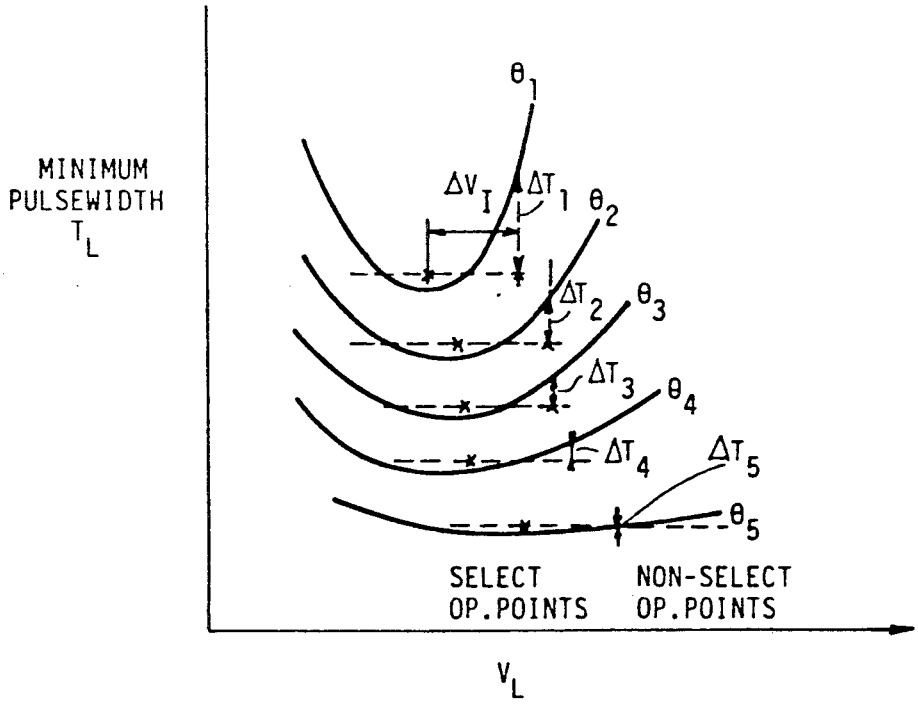

The steepness of the upturn in the e-o curve has a significant effect on the discrimination between the select and non-select multiplex states and consequently the width of the operating conditions window. As the steepness of the upturn decreases with increasing temperature the device eventually reaches a temperature at which it does not multiplex in the inverse mode (see FIG. 23). FIG. 23 shows a set of e-o curves for increasing temperature $\theta$ where $\theta_5>\theta_4>\theta_3>\theta_2\leqq\theta_1$. For a given $\Delta V_I$, the discrimination $\Delta T$ decreases with increase in temperature. It is possible to improve the discrimination a little, and hence the ability to multiplex, by increasing the data voltage and thus separating the select and non-select operating points further apart. Thus the non-select operating point lies further below the e-o curve well into the non-latching region (see FIG. 19 for example). However, taken too far this has the undesirable effect of increasing the crosstalk thus degrading the contrast of the device—the same net effect as loss in upturn steepness.

If, at a fixed temperature, a blanking pulse test is carried out in which the time between the blanking pulse and the latching pulse is increased (see FIG. 24) a set of e-o curves can be obtained which are similar in shape to those obtained when the temperature is varied, as in FIG. 20. FIG. 24 shows the effect of increasing the relaxation time $R_R$ on the e-o curve by reference to curves I, II, III and IV with respective relaxation times $T_{R1}$, $T_{R2}$, $T_{R3}$ and $T_{R4}$ wherein $T_{R4}>T_{R3}>T_{R2}>T_{R1}$; it can be seen that if the time between leading and trailing pulses becomes sufficiently large enough the e-o characteristic is the same as obtained in a monopolar pulse experiment (see FIG. 26) where the duty cycle becomes very large.

The e-o characteristics in FIG. 20 and 24 are a consequence of the same phenomenon. When a voltage pulse is applied of sufficient voltage and width to cause a device to switch and latch, such as a blanking pulse, it switches into a 'driven' state. At the end of the voltage pulse the device is then observed to relax back into a latched state, see FIG. 25 wherein $T_{R1}$ is greater than the relaxation time and $T_{R2}$ is less than the relaxation time, and $T_{L2}$ is greater than $T_{L1}$ for latching. In the case of the blanking pulse test and most multiplex schemes consisting of a leading and trailing pulse there is insufficient time for the device to relax after the leading pulse. Consequently the trailing pulse is trying to switch the device into the opposite state from effectively a blanked driven state. Thus the device requires a relatively wide trailing pulse. If sufficient time is allowed for the device to relax some way then it requires a much narrower pulse to switch into the opposite state. Hence introducing extra slots between the blanking and latching pulse in a typical three component scheme means smaller timeslots are needed. However, the device now operates on an e-o curve with an upturn which is reduced in steepness (such as one of the curves in FIG. 24 with an increased relaxation period) with a subsequent reduction in discrimination.

Similarly using a line blanking scheme means that greater time is allowed for relaxation between the blanking pulse and the select/non-select pulse and thus it is possible to use much narrower timeslots and address the device faster. If the device is blanked enough lines ahead then the device effectively operates with the monopolar pulse test e-o characteristic. Thus it is necessary, if the device is to operate in the inverse mode with good discrimination and a wide operating conditions window, for it to have a monopolar pulse e-o characteristic with an upturn.

When in the driven state the torque due to the negative dielectric anisotropy is much greater than when switching from a relaxed state. Consequently a highly non-linear e-o characteristic with a greater upturn is obtained. In the monopolar pulse test there is sufficient time between pulses to allow the device to relax fully into a latched, but relaxed, state. Consequently the opposing torque due to the dielectric anisotropy is smaller and it requires a narrower pulse to switch the device into the opposite state. Thus the upturn in the e-o curve for a monopolar pulse test is not so steep as in the blanking pulse test and the device response is faster.

An increase in temperature causes an increase in the relaxation rate so it has the same effect as allowing more time between the blanking and latching pulses. Hence the similarity between FIG. 20 and 24 and the eventual match of the monopolar and blanking pulse test e-o characteristics.

FIG. 26 shows the e-o curve for a monopolar pulse of amplitude V and pulse width T together with the repetitive monopolar pulse waveform used to produce that e-o curve. The voltage and pulsewidth of the blanking pulse at any given temperature is determined by the monopolar pulse e-o curve at that temperature, providing sufficient time has occurred between the last nondata pulse and the blanking pulse to ensure the device is in a relaxed and not driven state (which normally happens in ay multi-row matrix device). If the device is to operate over a range of temperatures at a constant addressing rate (assuming appropriate temperature compensation has been introduced into the latching pulses) then the pulsewidth and voltage of the blanking pulse is determined by the monopolar pulse e-o curve for the minimum operating temperature. Clearly, for the maximum addressing rate the blanking pulse is chosen to lie on the fastest part of the e-o curve.

I claim:

1. A method of addressing a display device comprising a matrix of separately operable pixels, the method comprising the step of applying across a given pixel a voltage waveform comprising a latching pulse and an auxiliary pulse of amplitude smaller than the latching pulse, the amplitude of the auxiliary pulse being modulated to determine the latching effect of the latching pulse.

2. A method according to claim 1, the amplitude of the latching pulse also being modulated.

3. A method according to claim 1 wherein the auxiliary pulse and the latching pulse have the same polarity.

4. A method according to claim 1 wherein the auxiliary pulse is temporally adjacent the latching pulse.

5. A method according to claim 4 wherein the auxiliary pulse immediately precedes the latching pulse.

6. A method according to claim 1 wherein said voltage waveform includes a further auxiliary pulse.

7. A method according to claim 1 wherein said voltage waveform includes a blanking pulse of opposite polarity to the latching pulse.

8. A method according to claim 1, said voltage waveform being produced by simultaneously applying a strobe voltage waveform and a data voltage waveform across said given pixel, modulation of the auxiliary pulse being effected by the data voltage waveform.

9. A method according to claim 8 including effecting temperature compensation by introducing a variable voltage component in the portion of the strobe voltage waveform corresponding to the auxiliary pulse.

10. A display device comprising a matrix of separately operable pixels and means for applying across a given pixel a voltage waveform comprising a latching pulse and an auxiliary pulse of amplitude smaller than the latching pulse, the applying means including means for modulating the amplitude of the auxiliary pulse to determine the latching effect of the latching pulse.

* * * * *